US010272578B2

(12) United States Patent
Johnson

(10) Patent No.: US 10,272,578 B2
(45) Date of Patent: Apr. 30, 2019

(54) HAIR CLIPPER BLADESET WITH BLADE GUIDE

(71) Applicant: WAHL CLIPPER CORPORATION, Sterling, IL (US)

(72) Inventor: Bruce V. Johnson, Sterling, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 151 days.

(21) Appl. No.: 15/249,809

(22) Filed: Aug. 29, 2016

(65) Prior Publication Data

US 2018/0056533 A1 Mar. 1, 2018

(51) Int. Cl.
*B26B 19/06* (2006.01)
*B26B 19/38* (2006.01)

(52) U.S. Cl.
CPC ..... *B26B 19/06* (2013.01); *B26B 19/3846* (2013.01)

(58) Field of Classification Search
CPC ..... B26B 19/06; B26B 19/3846; B26B 19/00; B26B 19/02; B26B 19/38
USPC ..... 30/221, 194, 208, 209, 43, 43.91, 43.92, 30/43.7–43.9, 241
See application file for complete search history.

(56) References Cited

U.S. PATENT DOCUMENTS 2,704,887 A 3/1955 Andis
5,068,966 A 12/1991 Wahl et al.
8,132,332 B2 * 3/2012 Tautscher ..... B26B 19/3846 30/208
9,770,836 B2 * 9/2017 Werner ..... B26B 19/06
2011/0265331 A1 11/2011 Moseman
2014/0259689 A1 9/2014 Lau
2016/0075039 A1 3/2016 Werner

OTHER PUBLICATIONS

Extended European Search Report from corresponding European Patent Application No. 17187895.2, dated Jan. 30, 2018.

* cited by examiner

*Primary Examiner* — Phong H Nguyen
(74) *Attorney, Agent, or Firm* — Greer, Burns & Crain, Ltd.

(57) ABSTRACT

A hair clipper bladeset is provided, including a stationary blade having a front edge having a plurality of stationary teeth, and a moving blade including a moving front edge having a plurality of moving teeth disposed such that the moving blade teeth laterally reciprocate relative to the stationary blade teeth to form a cutting edge. A cam follower is disposed upon an upper surface of the moving blade and includes at least one cam follower formation constructed and arranged for guiding the moving blade in reciprocation. A blade guide is located between the moving blade and the stationary blade, having at least one complementary blade guide formation configured for accommodating a corresponding said at least one cam follower formation for creating multiple contact points constructed and arranged for maintaining alignment of the blades at the cutting edge.

10 Claims, 7 Drawing Sheets

HAIR CLIPPER BLADESET WITH BLADE GUIDE

BACKGROUND

The present application relates generally to powered hair clippers, and more specifically to a hair clipper bladeset designed for supporting a moving blade in parallel alignment relative to a stationary blade throughout the reciprocal blade stroke.

Powered hair clipper bladesets include a moving blade reciprocating laterally relative to a stationary blade. The moving blade is connected to a motor drive shaft by an eccentric drive cam and a cam follower which translates the rotary motion of the motor drive shaft to the desired linear reciprocating blade motion. Springs associated with the bladeset exert a biasing force to urge the moving blade against the stationary blade. If the moving blade deviates from a parallel stroke relative to the stationary blade, the scalp of the subject person being cut can be nicked, or the cutting operation may be unsatisfactory in other ways.

To address this problem, it is known to provide guide components in clipper bladesets to maintain the stroke of the moving blade to a parallel relationship to the stationary blade throughout its cycle. One such blade assembly including a blade guide is disclosed in U.S. Pat. No. 5,068,966 which is incorporated by reference. However, one drawback of many conventional hair clipper bladeset blade guides is that they do not properly accommodate variations in component tolerances due to manufacturing processes. These tolerance deviations are more pronounced when the bladeset is adjusted for precision edge cutting or outlining.

Accordingly, there is a need for an improved hair clipper bladeset blade guide which addresses this design issue.

SUMMARY

The above-listed need is met or exceeded by the present hair clipper bladeset blade guide, which features multiple sliding contact points designed to maintain the moving blade in parallel relationship relative to the stationary blade throughout the moving blade stroke. Alignment of the blades is maintained even when tips of the respective moving and stationary blade teeth are in close proximity with each other, as is commonly used in creating sharp details in hairstyles.

These contact points include slots or formations in the blade guide which accommodate reciprocation of the overlying cam follower. In the preferred embodiment, contact points are provided by at least one and preferably two projection slots which accommodate the reciprocating action of depending projections of the cam follower. These projections are preferably provided in the form of depending pairs of projecting forks.

Another contact point is preferably centrally located on the blade guide, and/or between the projection slots. This latter contact point provides at least one biased projection which slidably engages a central slot in the moving blade located in spaced, parallel relationship to the blade cutting edge. In the preferred embodiment, the biased projection is provided as a pair of such projections, each projection slidably engaging a respective front or rear edge of the central blade slot. In this manner, tolerances in the manufacture of moving blades are accommodated, while maintaining the desired blade alignment.

In other words, the present blade guide features six contact points in two regions, which combine to reciprocally accommodate the reciprocal movement of the moving blade relative to the stationary blade, and to maintain that movement in precise parallel relationship to the cutting edge of the stationary blade throughout the stroke or operational cycle of the moving blade.

Another feature of the present blade guide is that the position of the moving blade cutting edge or toothed edge is adjustable relative to the stationary blade cutting edge without disassembly. Thus, using the present blade guide, the moving blade is adjustable independently of the position of the stationary blade.

More specifically, the present invention provides a hair clipper bladeset including a stationary blade having a front edge having a plurality of stationary teeth, a moving blade including a moving front edge having a plurality of moving teeth disposed such that the moving blade teeth laterally reciprocate relative to the stationary blade teeth to form a cutting edge. A cam follower is disposed upon an upper surface of the moving blade and includes at least one cam follower formation constructed and arranged for guiding the moving blade in the reciprocation. A blade guide is located between the moving blade and the stationary blade, having at least one complementary blade guide formation configured for accommodating a corresponding cam follower formation for creating multiple contact points constructed and arranged for maintaining alignment of the blades at the cutting edge.

In another embodiment, a hair clipper bladeset is provided including a stationary blade having a stationary blade body with an upper surface, an opposite bottom surface and a front edge having a plurality of stationary teeth. A moving blade includes a moving blade body with an upper surface, a bottom surface and a moving front edge having a plurality of moving teeth disposed such that the bottom surface of the moving blade faces the upper surface of the stationary blade and the moving blade teeth laterally reciprocate relative to the stationary blade teeth to form a cutting edge.

A cam follower is disposed upon the upper surface of the moving blade and includes at least one formation constructed and arranged for guiding the moving blade in the reciprocation. A blade guide is located between the moving blade and the stationary blade, having a plurality of openings accommodating at least one of the cam follower formations for creating multiple contact points constructed and arranged for maintaining alignment of the blades at the cutting edge.

DETAILED DESCRIPTION

Figure 1:
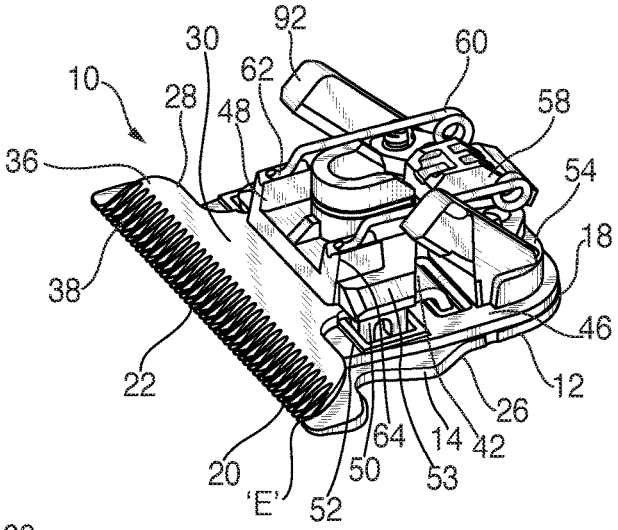
FIG. 1 is a top perspective view of the present hair clipper bladeset.
Figure 2:
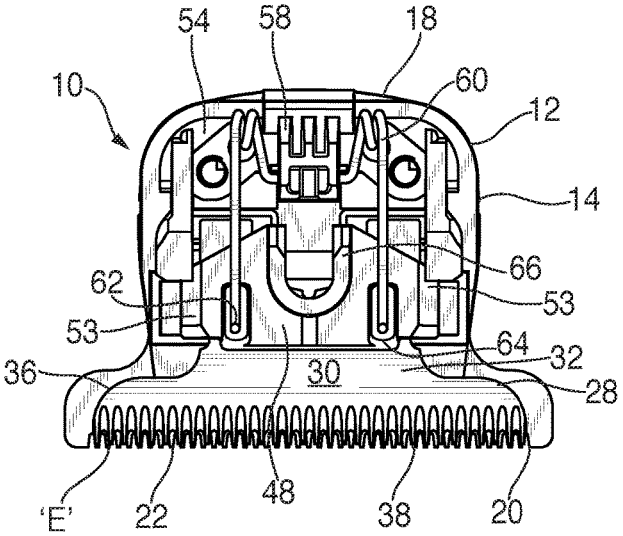
FIG. 2 is an overhead plan view of the present hair clipper bladeset.
Figure 3:
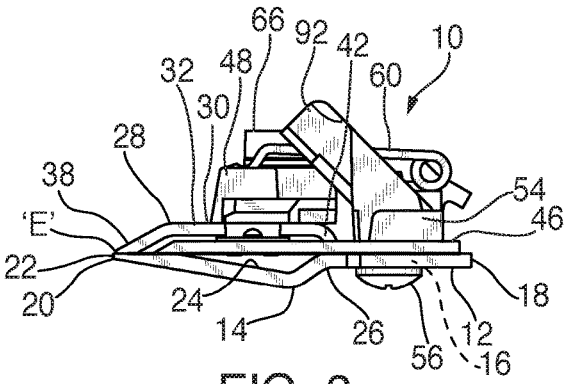
FIG. 3 is a right side view of the present hair clipper bladeset.

Referring to FIGS. 1-3, and 9-10, a bladeset for a powered hair clipper or hair trimmer is generally designated 10, and includes a stationary blade 12 having a stationary blade body 14, at least one and preferably a pair of mounting holes 16, a rear edge 18 and an opposite front edge 20 with a plurality of stationary blade teeth 22. An upper surface of the stationary blade 24 is opposite a lower surface 26 which is accessible by the user of the clipper.

Also included in the bladeset 10 is a moving blade 28 having a moving blade body 30, and having an upper surface 32, an opposite lower surface 34, a moving front edge 36 having a plurality of moving blade teeth 38. As is well known in the hair clipper art, the moving blade teeth 38 reciprocate laterally relative to the stationary blade teeth 22 to form a cutting edge "E." Upon assembly, the moving blade lower surface 34 faces the upper surface 24 of the stationary blade 12. Also included on the moving blade 28 is a rear edge 40 having at least one and preferably two rearwardly projecting heel formations 42. In addition, the moving blade body 30 has a guide slot 44 (FIGS. 4, 9 and 10) generally rectangular in shape and extending in a direction generally parallel to the direction of the cutting edge "E." It is contemplated that the shape of the guide slot 44 may vary to suit the application.

A blade guide 46 is generally planar and is disposed between the moving blade 28 and the stationary blade 12. As described in greater detail below, the construction and arrangement of the present blade guide 46 enhances the alignment of the moving blade 28 relative to the stationary blade 12 to maintain the cutting edge "E."

A cam follower 48 is disposed upon and engages the upper surface 32 of the moving blade 28 and includes at least one cam follower formation 50 constructed and arranged for operationally engaging complementary formations 52 on the blade guide 46 for maintaining blade alignment. In the present application, a formation is contemplated as taking the form of either a projection or a complementary opening receiving the projection. While other configurations are contemplated, in the preferred embodiment, the formations 50 are projections depending from the cam follower 48 and projecting through blade guide formations 52 in the blade guide 46 for guiding the moving blade 28 in the above-described reciprocating movement along the cutting edge "E." In the preferred embodiment the blade guide formations 52 are openings accommodating the projections 50. However, also contemplated are projections on the blade guide 46 engaging recesses or openings in the cam follower 48. In the preferred embodiment, the cam follower 48 has a pair of laterally extending arms 53 (FIGS. 1 and 2), each with one of the depending formations 50, and the formations are preferably provided with a dual-tined forked shape. The blade guide openings 52 are dimensioned for accommodating the formations 50 during the cycle of reciprocation of the moving blade 28 relative to the stationary blade 12. As the bladeset 10 is assembled, the blade guide 46 is secured to the stationary blade 12, and the moving blade 28 and the cam follower 48 reciprocate relative to the blade guide.

The bladeset 10 further includes a blade chassis 54 mounted upon the blade guide 46 and providing a base for movement of the cam follower 48. In the preferred embodiment, the blade chassis 54 is attached to both the blade guide 46 and the stationary blade 12 by at least one and preferably a pair of fasteners 56, such as threaded screws. A clip 58 on the blade chassis 54 receives a clamping spring 60. Generally "U"-shaped when viewed from above (FIGS. 2, 9 and 10), the clamping spring 60 has a pair of free ends 62 that are accommodated in spring grooves 64 in the cam follower 48. As is known in the art, the clamping spring 60 urges the cam follower 48 against the moving blade 28, and as such urges the moving blade against the stationary blade 12 to facilitate the reciprocating cutting action. Also, as is known in the art, the cam follower 48 includes a drive socket 66 constructed and arranged for receiving an end of an eccentric drive connected to the clipper drive motor (not shown), which creates the reciprocating cutting action of the moving blade 28 relative to the stationary blade 12.

Referring now to FIGS. 4-18, the generally planar blade guide 46 is preferably made of sturdy plastic, by injection molding, 3D printing or similar known technology, and has a front edge 68 parallel to and in close proximity to the cutting edge "E," and an opposite rear edge 70 with at least one and preferably two mounting apertures 72 in close proximity upon assembly of the bladeset 10, the mounting apertures 72 are in registry with the mounting holes 16 on the stationary blade 12, as well as mounting bores 74 (FIG. 10) on the blade chassis 54. It will be appreciated that the diameters of the mounting apertures 72 and the mounting holes 16 are larger than shafts of the fasteners 56, which are snugly engaged in the mounting bores 74. Thus, after assembly of the bladeset 10 and its installation on the respective trimmer or clipper, the user can loosen but not remove the fasteners 56, and change the setting of the cutting edge "E" by moving the stationary blade 12 and the blade guide 46 relative to the chassis 54, the cam follower 48 and the moving blade 28. Once the cutting edge "E" is reset, the fasteners 56 are retightened.

A main feature of the blade guide 46 is that it provides multiple contact points for the cam follower 48 and the moving blade for maintaining alignment of the moving blade 28 relative to the stationary blade 12 during its reciprocating action at the cutting edge "E." In the present application, the phrase "contact points" refers to the engagement of complementary cam follower formations 50 on the cam follower 48 with the blade guide formations 52 on the blade guide 46 in a sliding relationship. Other such formations are discussed below. It is contemplated that due to variations in tolerances of the respective formations on the cam follower 48 and the blade guide 46, in some cases the amount of actual contact will vary. Also, the blade guide 46 and the cam follower 48 are preferably made of durable plastic, which creates less friction than plastic-to-metal or metal-to-metal sliding action, and is easier for a manufacturer to control respective component tolerances. Two of the contact points have been discussed above, the blade guide openings 52. Thus, the blade guide openings 52 are wider than the respective moving formations 50 that they accommodate.

Figure 4:
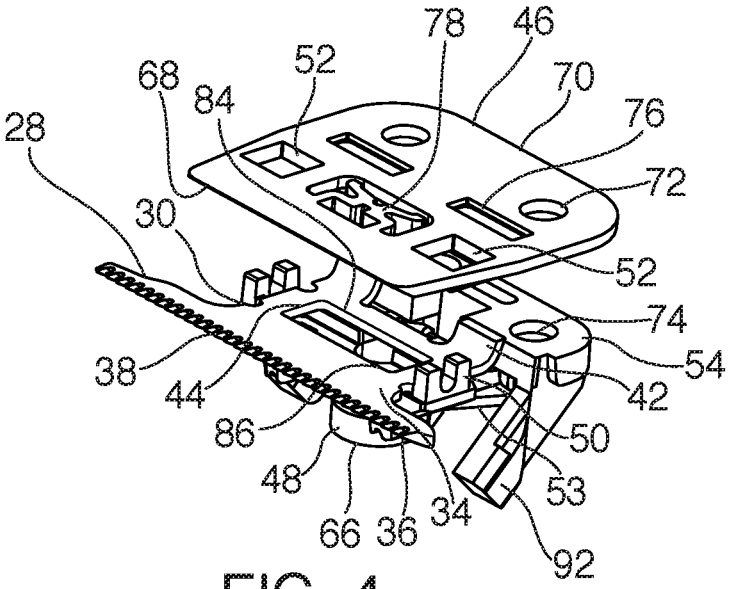
FIG. 4 is a fragmentary inverted exploded view of the present blade guide, blade chassis, cam follower and moving blade.
Figure 5:
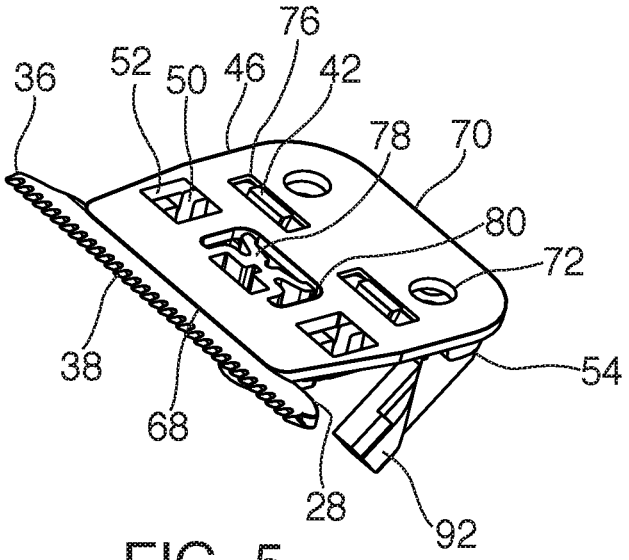
FIG. 5 is a fragmentary inverted assembled perspective view of the present blade guide, moving blade, blade chassis and cam follower.
Figure 6:
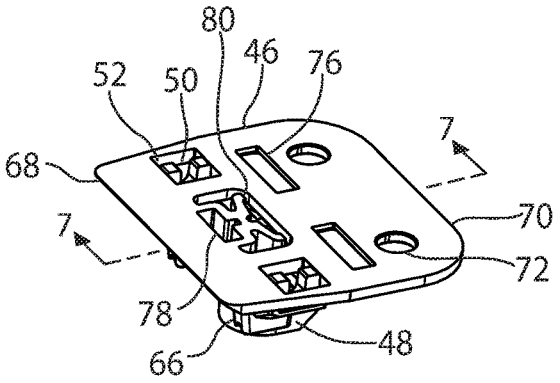
FIG. 6 is an inverted perspective view of the present blade guide and cam follower.
Figure 7:
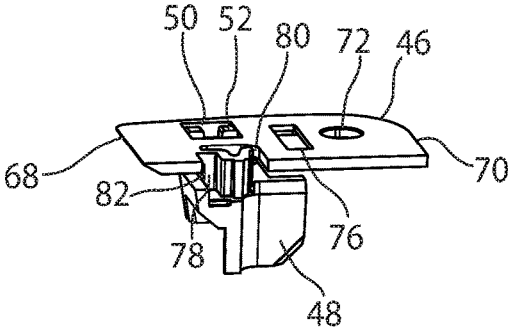
FIG. 7 is a fragmentary cross-section of the present bladeset taken along the line 7-7 of FIG. 6 and in the direction generally indicated.

In addition, the blade guide 46 is provided with a blade heel slot 76 for accommodating each of the moving blade heel formations 42 during the reciprocation of the moving blade 28. However, in the preferred embodiment, these heel slots 76 do not perform a blade guiding function, and instead are dimensioned for providing clearance for reciprocation of the blade heel formations 42. As seen in FIGS. 4-6, the heel slots 76 are positioned on the blade guide 46 between the mounting apertures 72 and the blade guide openings 52, and extend generally parallel to the cutting edge "E." Thus, the cam follower 48 and the moving blade engage the blade guide 46 at at least four contact points, counting the forked formations 50 are counted by the tines.

Referring now to FIGS. 4, 5, 7, 8, 12, 15 and 17, another contact point as described above between the blade guide 46 and the cam follower 48 is formed by a vertically projecting formation 78 on the blade guide 46 which complementarily engages, via a slip fit the guide slot 44 on the moving blade 28 during reciprocation of the moving blade 28 relative to the stationary blade 12.

More specifically, the vertically projecting formation 78 is generally "X"-shaped (FIGS. 4-8), and has two vertical rear edges 80 and two vertical front edges 82. These edges 80, 82 are dimensioned slidingly engage corresponding rear and front edges 84, 86 of the guide slot 44 (FIG. 4). At the same time, FIGS. 5, 13 and 18 also depict the close fitting, sliding relationship between the blade guide openings 52 and the depending cam follower formations 50. Counting each of the edges 80 and 82 of the formation 78, and the bifurcated cam follower formations 50 as two contact points, it will be seen that the present blade guide 46 creates eight contact points with the other components of the bladeset 10. It has been found that these multiple contact points have significantly improved the ability of the present bladeset 10 to maintain desired blade alignment throughout the operational cycle, as well as accommodate variations in manufacturing tolerances.

Figure 8:
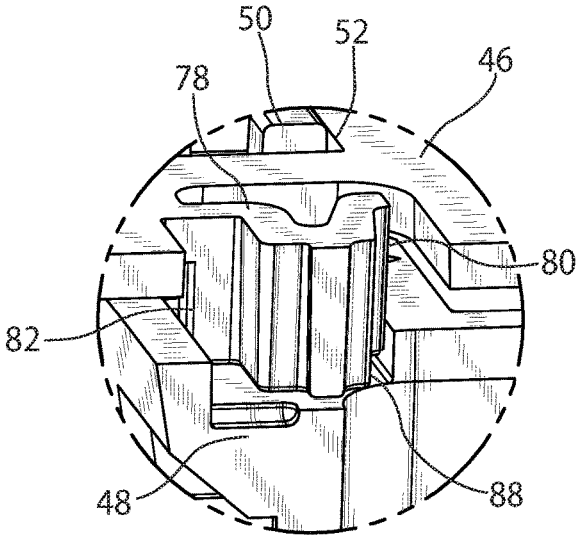
FIG. 8 is a fragmentary enlargement of FIG. 7.
Figure 12:
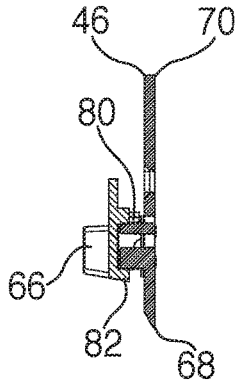
FIG. 12 is a cross-section taken along the line 12-12 of FIG. 11 and in the direction generally indicated.
Figure 11:
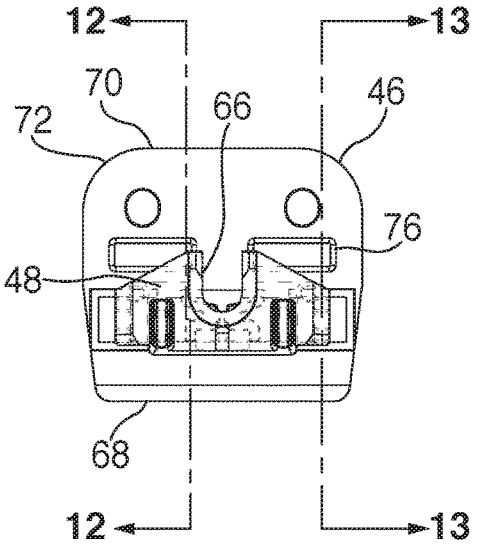
FIG. 11 is a top plan view of the present cam follower and blade guide.
Figure 13:
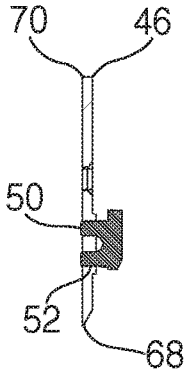
FIG. 13 is a cross-section taken along the line 13-13 of FIG. 11 and in the direction generally indicated.
Figure 14:
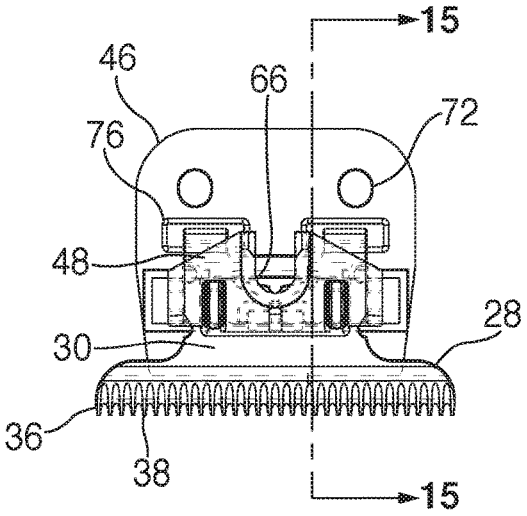
FIG. 14 is a top plan view of the present cam follower, moving blade and blade guide.
Figure 15:
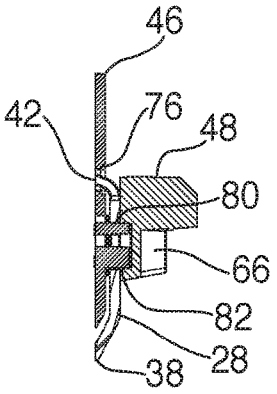
FIG. 15 is a cross-section taken along the line 15-15 of FIG. 14 and in the direction generally indicated.
Figure 16:
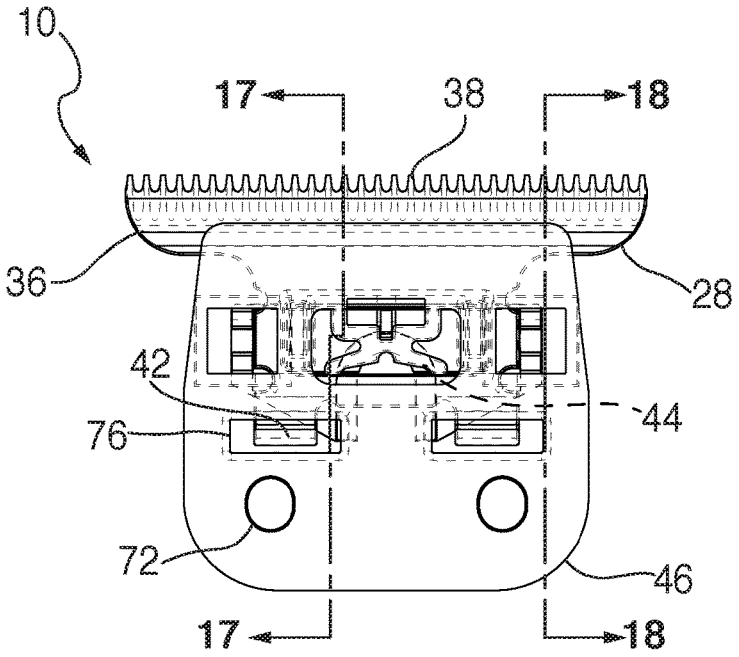
FIG. 16 is a bottom plan view of the present blade guide with the cam follower and moving blade.
Figure 17:
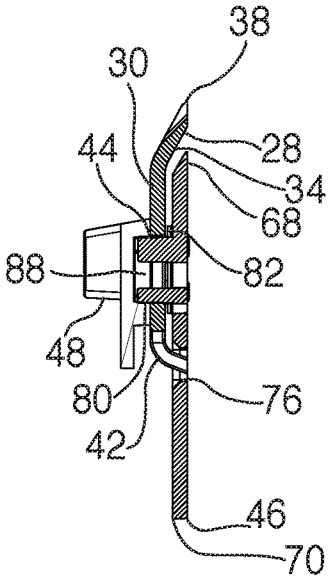
FIG. 17 is a vertical cross-section taken along the line 17-17 of FIG. 16 and in the direction generally indicated.
Figure 18:
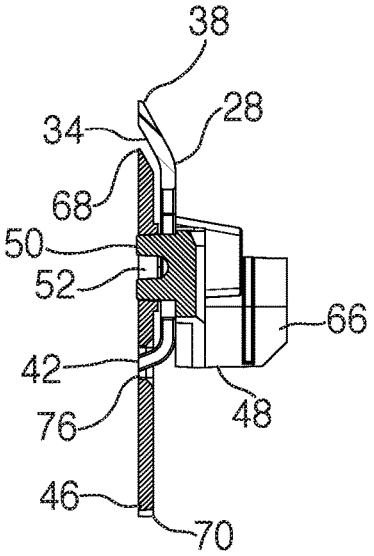
FIG. 18 is a cross-section taken along the line 18-18 of FIG. 16 and in the direction generally indicated.

In addition, as seen in FIGS. 8, 12 and 15, the vertically-projecting formation 78 is slidingly received or captured in a cam follower formation referred to as a track 88 in the cam follower 48. As is the case with the blade guide openings 52 and the heel slots 76, the track 88 extends laterally parallel to the cutting edge "E" a greater distance than a width of the vertically-projecting formation 78 to accommodate the operational sliding motion. Further, the edges 80, 82 of the vertically-projecting formation 78 are dimensioned to form a close, sliding, biased fit within the track 88, while the formation 78 passes through the blade slot 44 without touching the slot.

Also, the blade chassis 54 is provided with at least one and preferably a pair of clipper/trimmer locator arms 92 for facilitating the mounting of the bladeset 10 into the respective clipper or trimmer, as is known in the art.

Figure 9:
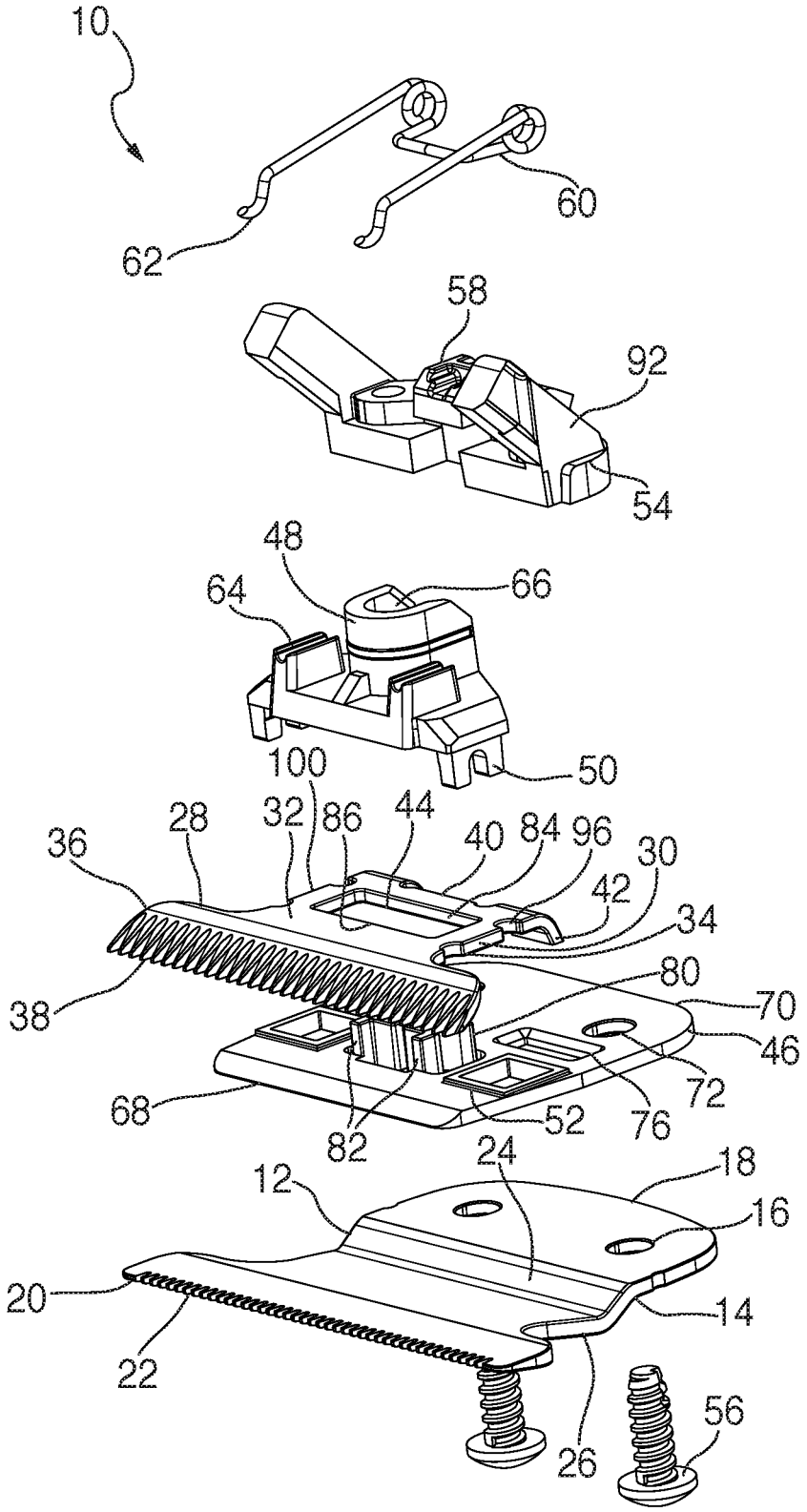
FIG. 9 is an exploded top perspective view of the present bladeset.
Figure 10:
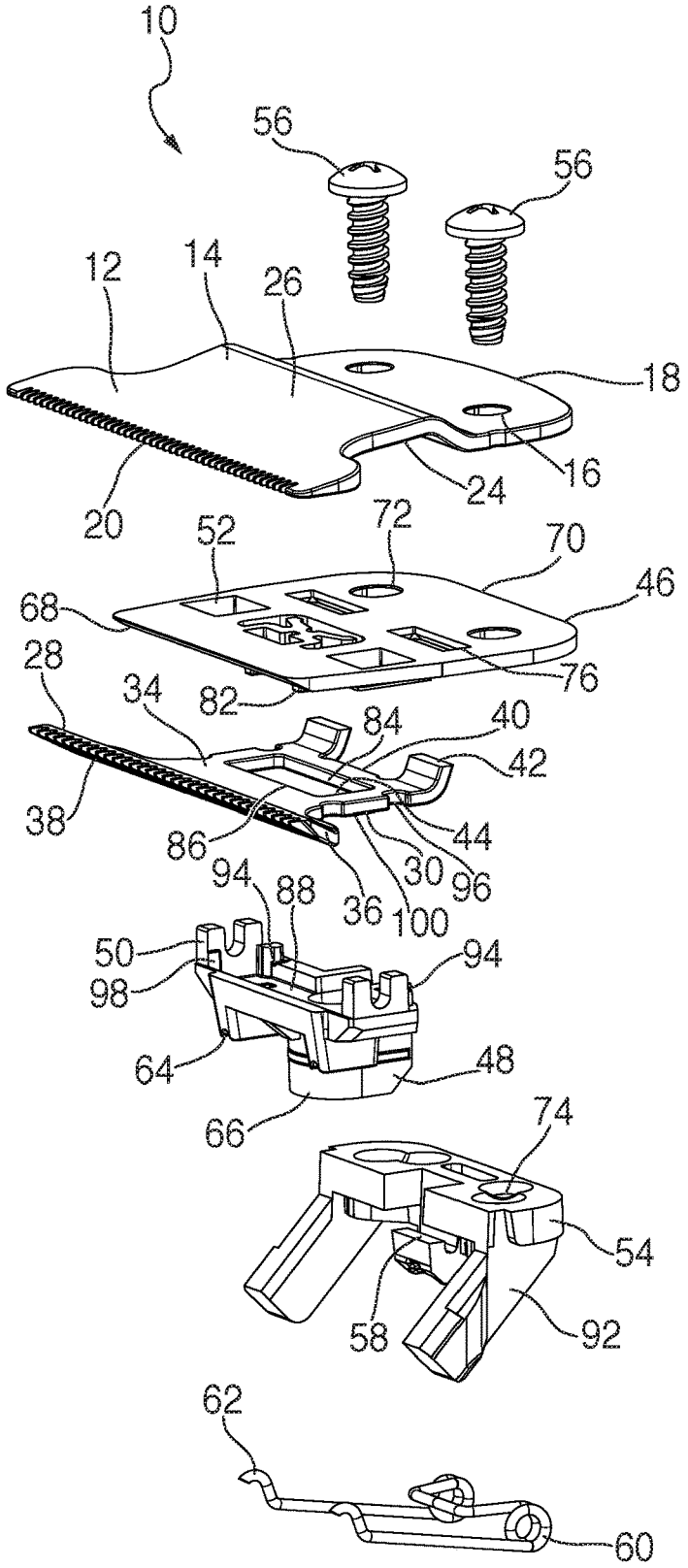
FIG. 10 is an exploded bottom perspective view of the present hair clipper bladeset.

Referring now to FIGS. 9 and 10, additional guidance of the moving blade 28 is provided by a plurality of and preferably a pair of pegs 94 on the cam follower 48 near the formations 50 which engage complementary notches 96 in the moving blade 28. In the preferred embodiment, there are two, preferably semi-cylindrical pegs 94 on the cam follower 48 that engage a complementary pair of the semi-circular notches 96 near the moving blade rear edge 40. Also, the cam follower 48 has a pair of crush ribs 98 located on inner sides of the formations 50 that frictionally engage sides 100 of the moving blade 28 to further secure the moving blade to the cam follower for maintaining the desired blade alignment. In this manner, the moving blade 28 and the cam follower 48 are positively joined for common movement during clipper operation.

While a particular embodiment of the present hair clipper bladeset with blade guide has been described herein, it will be appreciated by those skilled in the art that changes and modifications may be made thereto without departing from the invention in its broader aspects and as set forth in the following claims.

The invention claimed is:

1. A hair clipper bladeset, comprising:

a stationary blade having a front edge having a plurality of stationary teeth;

a moving blade including a moving front edge having a plurality of moving teeth disposed such that said moving blade teeth laterally reciprocate relative to said stationary blade teeth to form a cutting edge;

a cam follower disposed upon an upper surface of said moving blade and including at least one cam follower formation constructed and arranged for guiding said moving blade in said reciprocation;

a blade guide located between said moving blade and said stationary blade, having at least one complementary blade guide formation configured for accommodating a corresponding said at least one cam follower formation for creating multiple contact points constructed and arranged for maintaining alignment of said blades at said cutting edge; and said cam follower engages said blade guide at at least four contact points, each contact point formed by a separate depending projection on said cam follower, and all of said depending projections extending in the same direction.

2. The hair clipper bladeset of claim 1, wherein said moving blade includes a guide slot, and said at least one blade guide-formation includes a complementary projection engaging said guide slot during reciprocation of said moving blade relative to said stationary blade.

3. The hair clipper bladeset of claim 2, wherein said complementary blade guide projection is constructed and arranged to exert a biasing force against said reciprocating moving blade for maintaining blade alignment along said cutting edge.

4. The hair clipper bladeset of claim 1, wherein said blade guide is secured to said stationary blade and said moving blade and said cam follower reciprocate relative to said blade guide.

5. The hair clipper bladeset of claim 4, further including a blade chassis secured to said blade guide and to said stationary blade.

6. The hair clipper bladeset of claim 5, further including a biasing element mounted on said blade chassis for engaging and urging an upper surface of said cam follower against said moving blade for biasing said moving blade against said stationary blade.

7. The hair clipper bladeset of claim 1, wherein said moving blade has a guide slot and at least one of said at least one blade guide formations includes a complementary projection configured for slidably engaging said guide slot.

8. A hair clipper bladeset, comprising:

a stationary blade having a stationary blade body with an upper surface, an opposite bottom surface and a front edge having a plurality of stationary teeth;

a moving blade including a moving blade body with an upper surface, a bottom surface and a moving front edge having a plurality of moving teeth disposed such that said bottom surface of said moving blade faces said upper surface of said stationary blade, said moving blade teeth laterally reciprocate relative to said stationary blade teeth to form a cutting edge;

a cam follower disposed upon said upper surface of said moving blade and including at least four cam follower projections constructed and arranged for guiding said moving blade in said reciprocation, said cam follower projections extending in a first direction; and a blade guide located between said moving blade and said stationary blade, having a plurality of openings accommodating said at least four cam follower projections for creating multiple contact points constructed and arranged for maintaining alignment of said blades at said cutting edge; and said moving blade has a body including a guide slot, and said blade guide includes a complementary projection extending in an opposite direction from said cam follower projections and engaging said guide slot during reciprocation of said moving blade relative to said stationary blade.

9. The hair clipper bladeset of claim 8, wherein said complementary projection is constructed and arranged to exert a biasing force against said reciprocating moving blade for maintaining blade alignment along said cutting edge.

10. The hair clipper bladeset of claim 9, wherein said cam follower includes a track for accommodating said complementary projection.

* * * * *